United States Patent [19]

Cartwright

[11] 4,146,426

[45] Mar. 27, 1979

[54] APPARATUS FOR THE MANUFACTURE OF PAPER AND BOARD

[76] Inventor: Frederick D. Cartwright, 506 Lake Club Apts., Lake Rd., Germiston 1401, Transvaal, South Africa

[21] Appl. No.: 777,080

[22] Filed: Mar. 14, 1977

[51] Int. Cl.[2] ..... D21F 1/02; D21F 1/40

[52] U.S. Cl. ..... 162/306; 162/314; 162/317; 162/336

[58] Field of Search ..... 162/215, 214, 213, 292, 162/306, 307, 314, 315, 317, 325, 336, 351, 217, 344

[56] References Cited

U.S. PATENT DOCUMENTS

| | | | |
|---|---|---|---|
| 1,984,484 | 12/1934 | Kilberry | 162/351 X |
| 2,265,455 | 12/1941 | Serpas | 162/213 |
| 3,201,306 | 8/1965 | Hornbostel, Jr. | 162/213 |
| 4,008,122 | 2/1977 | Welte | 162/306 X |

FOREIGN PATENT DOCUMENTS 329988 2/1914 Fed. Rep. of Germany.

*Primary Examiner*—Richard V. Fisher
*Attorney, Agent, or Firm*—Stevens, Davis, Miller & Mosher

[57] ABSTRACT

The invention is concerned with a method and apparatus for use in the manufacture of paper and board in which pulp in suspension is directed at such an angle and at such a speed towards a screen travelling at a determined speed that the resultant direction of travel of the pulp relative to the screen is substantially at right angles to the screen. In a preferred form of the invention, the pulp suspension is discharged onto the screen as a curtain which extends across a substantial portion of the width of the screen. The invention also provides a chamber into which the pulp is discharged onto the screen, the chamber being sealed at inlet and outlet ends by rollers. The invention further provides for a pulp web formed on the screen to be transferred from the screen onto the roller at the outlet end by means of discharge vents located below the roller and the screen.

7 Claims, 10 Drawing Figures

Fig 2.
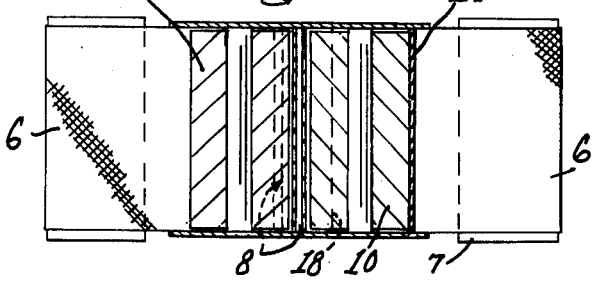
Fig 3.
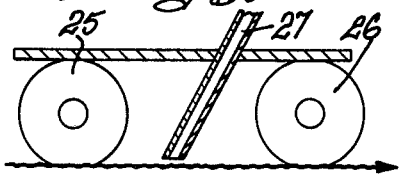
Fig 5.
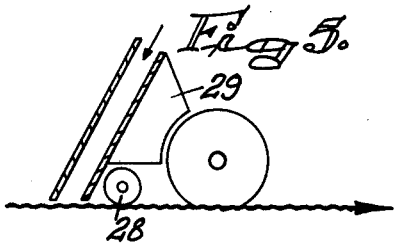
Fig 4.
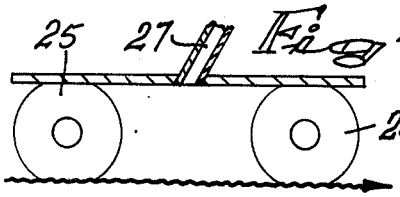
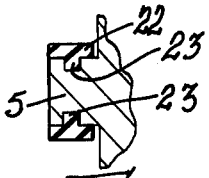
Fig 7.
Fig 8.
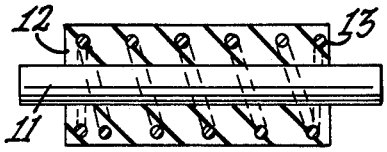
Fig 6.
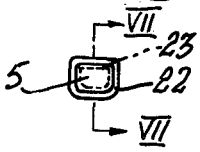
Fig 9.
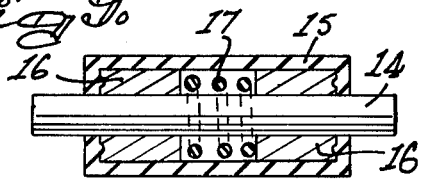

APPARATUS FOR THE MANUFACTURE OF PAPER AND BOARD

FIELD OF THE INVENTION

This invention relates to a method and apparatus for the manufacture of paper and board in which pulp in suspension is deposited onto a moving screen to form a web.

The moving screen may be in the form of a suitable mesh, for instance, in the form of an endless belt or a drum having a perforated outer surface.

BACKGROUND OF THE INVENTION

Wood provides the most common source of cellulosic material for the manufacture of paper. The wood is transformed into a paper pulp suspension using either a mechanical process in which the fibers are broken down through physical contact with, for instance, a rotating member or a chemical process, for instance, involving pressure-cooking wood chips in a suitable chemical solution.

The chemical process is preferred as it provides not only a pulp having an average fiber length longer than that produced by the mechanical process but also a stronger fiber, both of which factors lead to a better quality paper. After pulping of the wood it is "refined", a process which frays and flattens the pulp fibers making the fibers softer, more plastic and increasing their surface area. These conditions lead to the fibers bonding more strongly to one another to produce a stronger and therefore better quality paper. Sizing materials, mineral pigments, etc. may then be added to the pulp suspension.

At this stage, the pulp suspension may have a solids content of only one percent and generally has a thin milky appearance.

Where top quality paper is required, for instance for important documents, the paper is "hand made" from the pulp. The pulp suspension, contained in a suitable tank, is bottom-stirred to keep it in a uniform suspension. A sieve is then lowered, edge first, into the tank and the edge is then drawn slowly towards the papermaker until the sieve occupies a substantially horizontal position. As a result, pulp is collected on the sieve.

The sieve is then raised and the water allowed to drain away. By means of various canting and shaking movements, the papermaker causes the pulp to settle in a uniform mat which is further processed to provide sheets of paper.

A characteristic of paper made as described above is that the fibers are arranged in all directions without there being noticeable orientation of fibers in a particular direction. As a result, a paper of top quality is produced which has substantially the same parting strength in all directions contained in the plane of the paper.

One of the earliest machines developed for the industrial manufacture of paper is the so called Fourdrinier machine. In this machine there is employed an endless screen in the form of a mesh belt. The fibers, fillers, pigments and the like in the suspension are allowed to flow from a head box through below a "slice" or gate onto the belt in a direction substantially parallel to the horizontal surface of the belt. Water, together with "fines" comprising short-length fibers, filler, pigment and other fine materials pass through the belt until the web is fairly well packed on the belt after which stage there is a tendency for the "fines" to be trapped in or on the web.

The web is then further processed to remove excess water by passing the belt and web along suitable rollers and suction boxes. The web may then be lifted off the belt and further treated to provide the desired paper product.

When the pulp passes through below the "slice" or gate it is travelling at approximately the same rate as the belt. As the fibers flow from under the "slice," there is a tendency for them to line up in the direction of travel of the belt. In the art, such direction of travel is commonly referred to as the "machine direction". As a consequence of such fiber orientation, paper made on a Fourdrinier-type machine has greater strength and stretchability in the machine direction that in a direction transverse thereto. This disparity between the strength and stretchability of machine-made paper in the machine and cross-machine direction increases with increase in the speed of the screen until, at high speeds, only a poor quality paper can be produced.

In an attempt to equalize more nearly the strengths of the finished paper in the machine direction and in the cross-machine direction, the screen support was made to oscillate horizontally, thus providing a shake in the screen as the water is drained from the web. For both economic and mechanical reasons it has been found impractical to provide an oscillating screen at screen speeds above 1,000 feet per minute and the use of such oscillating mechanisms must, therefore, be abandoned in the high speed production of pulp webs for paper and board production.

An object of the present invention is the provision of a method and apparatus for use in the high speed manufacture of paper and board in which the degree of fiber orientation during laying-up of the pulp web is reduced when compared to the degree of fiber orientation obtained on a Fourdrinier-type machine at similar high speeds.

SUMMARY OF INVENTION

According to the invention, a method for manufacturing paper and board involving the deposition of a pulp on a moving screen includes the step of directing a stream of pulp in suspension towards the screen at an angle to the screen and at a velocity so chosen that the pulp's resultant direction of movement, relative to the screen, is substantially at right angles to the screen.

In the preferred form of the invention, the pulp in suspension is directed as a curtain towards the screen, the curtain extending transversely to the direction of movement of the screen.

Another aspect of the invention is concerned with apparatus suitable for use in the manufacture of paper and board, including a screen for movement along a determined path and at a predetermined speed, a contained feed way for directing a stream of pulp in suspension towards the screen, the initial feed way being located at such an angle to the screen that, for a selected pulp suspension flow rate, the pulp's resultant direction of travel, relative to the screen, is substantially at right angles to the screen.

The feed way terminates preferably in a slit formation suitable for discharging the pulp suspension as a curtain extending across at least portion of the width of the screen. The screen may comprise a belt, preferably an endless belt.

Further according to the invention the apparatus includes a chamber into which the feed way discharges, the chamber having an inlet through which the screen passes into the chamber, an outlet through which the screen leaves the chamber and liquid sealing means at both the chamber inlet and the chamber outlet.

The liquid sealing means may include one or more rollers. In one form of the invention, a roller for picking the pulp web up off the screen forms the seal at the outlet end of the chamber.

Also according to the invention, the apparatus includes one or more discharge vents located below the screen for moving a pulp web formed on the screen into firm contact with the roller.

The screen may be supported, for at least part of its travel through the chamber, on at least one belt.

A further aspect of the invention is concerned with paper and board when made by the description of a pulp on a moving screen in which the pulp suspension is directed towards the screen at an angle to the screen and at a velocity so chosen that the pulp's resultant direction of travel, relative to the screen, is substantially at right angles to the screen.

By way of example only, a preferred form of the invention will now be described with reference to the accompanying drawings in which:

FIG. 1*a* is a diagram showing the layout of one form of the apparatus according to the invention;

FIG. 1*b* shows an enlarged portion of FIG. 1*a;*

FIG. 2 is a sectional plan view of the invention on the line II—II of FIG. 1*a;*

FIG. 3 is a diagram showing the layout of a second form of apparatus according to the invention;

FIG. 4 is a diagram showing the layout of a third form of apparatus according to the invention;

FIG. 5 is a diagram showing the layout of a fourth form of apparatus according to the invention;

FIG. 6 is a side view of a belt and supporting ledge for use in apparatus according to FIGS. 1*a* to 5;

FIG. 7 is a section on the line VII—VII of FIG. 6;

FIG. 8 is an axial section of one form of roller for use with apparatus according to FIGS. 1*a* to 5; and FIG. 9 is an axial section of a second form of roller for use with apparatus according to FIGS. 1*a* to 5.

DETAILED DESCRIPTION OF THE DRAWINGS

Figure 1A:
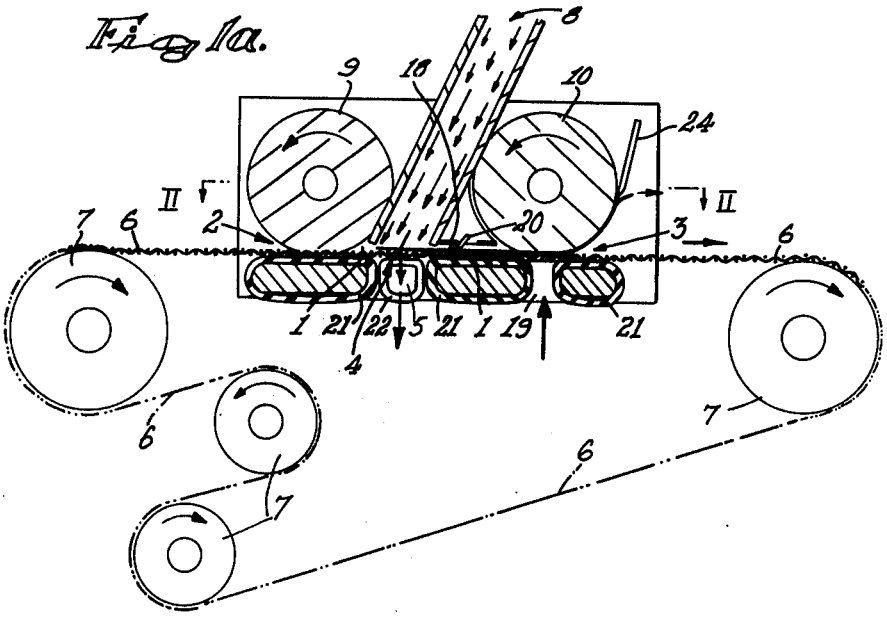

In FIG. 1*a* of the accompanying drawings, there is shown one form of the invention in which a closed chamber 1 is provided which has an inlet 2 located at one side towards the bottom of the chamber and an outlet 3 located at the opposite side towards the bottom of the chamber. Both the inlet and the outlet extend substantially the full width of the chamber.

A discharge orifice 4 is provided in the floor of the chamber at a point between the inlet 2 and the outlet 3. Such discharge orifice is of slit formation and extends substantially over the width of the floor of the chamber to leave between the ends of the orifice and the walls of the chamber support ledges 5. Further reference will be made to these support ledges below.

An endless screen 6 manufactured from a suitable wire mesh is passed into the chamber 1 through inlet 2 and moves over the floor of the chamber and across the discharge orifice before passing out from the chamber through outlet 3. The screen is returned to the inlet 2 via suitable rollers 7, and one or more of such rollers may be power driven. The width of the screen is such that it extends substantially over the entire width of the chamber, i.e. from the one chamber wall to the other chamber wall.

The top of the chamber is fitted with a feed way 8 through which a pulp suspension can be directed at an angle towards the screen 6. As will be seen from FIG. 1*a* the discharge end of the feed way is located above the discharge orifice 4.

In order to prevent leakage from the interior of the chamber, two rollers 9, 10 are provided, the rollers extending across the screen to bear in sealing relationship against the sides of the chamber as shown in FIG. 2. One or both rollers may be power driven.

By way of example, two forms of roller are shown in FIGS. 8 and 9 of the accompanying drawings. In the case of FIG. 8, the roller comprises a shaft 11, the ends of which are suitably journalled in bearings (not shown) provided in the walls of the chamber. The shaft is provided with a rim 12 of resilient material, for instance a rubber or rubber-like material, in which there is embedded a coil spring 13 that acts to force the rim ends outwards into sealing relationship with the walls of the chamber in the manner shown in FIG. 2 of the drawings.

The roller shown in FIG. 9 also includes a shaft 14. In this case, an end-closed sleeve 15 is fitted over the shaft. Between the sleeve walls and the shaft two pressure pads 16 are provided which are located co-axial with the shaft 14. The pressure pads are forced outwards by a coil spring 17 to urge the ends of the sleeve 15 into sealing relationship with the walls of the chamber.

Sealing of the inlet to the chamber is effected, in the case of the roller 9, by mounting the roller so that its outer rim bears firmly against the screen 6 on the floor of the chamber and against the feed way 8 while its ends bear against the sides of the chamber walls in the manner described above.

In the case of roller 10, sealing is achieved by mounting the roller so that its outer periphery bears firmly against the feed way 8 and the screen 6 while its ends bear firmly against the chamber walls. In addition, this roller is provided with a sealing plate 18 mounted on the feed way and to the walls of the chamber to bear against the roller periphery.

A further transverse slit 19 is provided in the floor of the chamber, the slit being located below the roller 10 and extending the width of the screen. Over the bottom of this slit there is fitted an air supply line (not shown) for directing a stream of air under pressure onto the screen.

Through the sealing plate 18 there are passed two fine water jets 20. These jets act to trim both sides of the pulp web formed on the screen 6.

Because of the pressure exerted by the rollers 9, 10 on the screen 6 there is a tendency for both the screen and the floor of the chamber to wear. In order to overcome this difficulty, endless rubber belts 21 are provided which pass over the chamber floor and on which belts the screen is supported. Because of the friction between the screen and these belts, the belts move in conjunction with the screen. There is thus no slip between the screen and the belts and as a result, no wear on the screen or the upper surfaces of the belts. At the same time, the belts are lubricated continuously by water from the chamber interior thereby reducing any wear that might otherwise have taken place between the belts and the chamber floor.

As suction applied to the underside of the screen may cause the screen to be drawn down into the discharge orifice 4, support ledges 5 for the screen edges are provided at both ends of the orifice. These ledges have already been described above. In order to minimize wear on the ledges, the ledges are fitted with rubber or the like belts 22 as shown in FIGS. 6 and 7 of the accompanying drawings. The ledges are provided with slots that extend in the screen's direction of travel. These slots receive ribs 23 provided on the belts for controlling lateral movement of the belts. As in the case of belts 21, the frictional forces generated between the screen and the belts cause the belts to be drawn along with the screen. The belts are lubricated by water from the chamber, thus facilitating their movement round the ledges.

In use, the screen 6 is set in motion and moved through the chamber at a constant, predetermined speed. As a result, the belts 21, 22 in contact with and supporting the screen move with the screen over the floor of the chamber.

A pulp suspension is then pumped under pressure through the feed way to be discharged onto the screen at a point above orifice 4. By terminating the discharge end of the feed way 8 in a slit formation, the pulp suspension discharges as a curtain onto the screen below it. Water, together with short fibers initially pass through the screen and may be recirculated while fibers of longer length build up on the screen to form a mat on which fines, small fibers and the like are caught and build up also on the continuously moving screen.

Figure 1B:
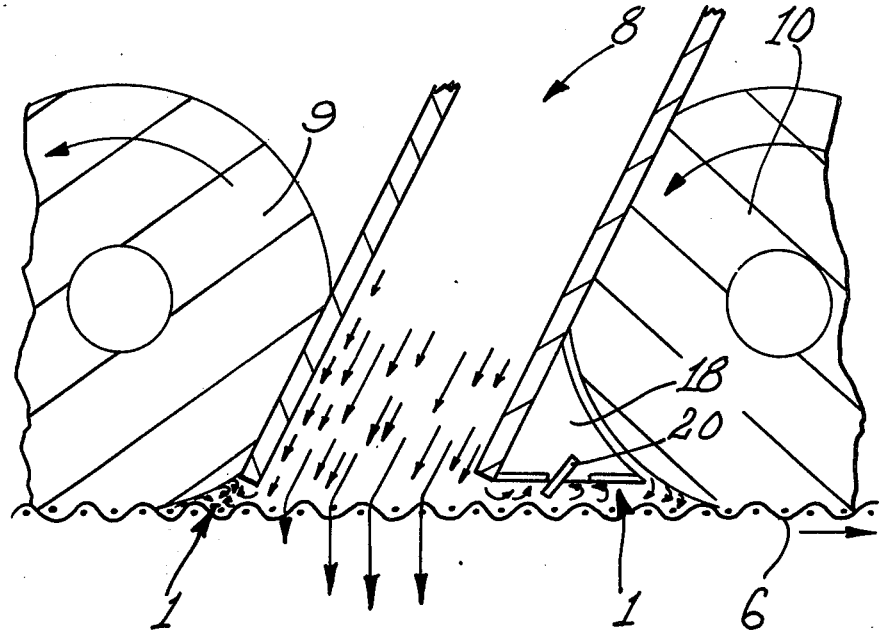

The pressure applied in pumping the pulp through the feedway 8 is of such magnitude that, in addition to drainage through orifice 4, closed chamber 1 is filled in the initial operating stage. Thus, a contained way is created for the current carrying the pulp suspension between the discharge end of the feedway 8 and the orifice 4 by the surrounding regions of the closed chamber 1 which contain substantially still pulp suspension, under pressure. An approximation of the currents in the contained way and the substantially stilled regions are shown in FIG. 1*b*.

By regulating the angle of incidence of the pulp stream discharged from the feed way relative to the screen and the rate at which the pulp stream is discharged, the pulp in the stream can be given a resultant direction, relative to the screen, which is substantially perpendicular to the screen's direction of movement and hence to the screen. The pulp fibers, therefore, have an apparent direction of flow perpendicular to the plane of the screen. The result is that there is complete disorientation of the fibers in the web formed on the screen to provide a pulp web approaching the random arrangement of fibers found in hand-made papers.

As the web passes under through the fine water jets 20, the edges of the web are trimmed neatly.

The web is transferred from the screen onto the roller by means of the pressure of the air on the underside of the screen as it passes over the transverse slit 19 in the floor of the chamber. From here the web is transported by means of the roller 10 to a "doctor" 24 or other means, for instance, a suction roller, where it is stripped off the roller and transported by known apparatus (not shown) through further known stages in the production of paper.

A second form of the invention is shown in FIG. 3. Instead of the rollers 25, 26 forming a seal with the feed way as was the case in FIGS. 1 and 2, these rollers form a seal with top members.

A third form of the invention is shown in FIG. 4. Instead of the feed way 27 extending into the chamber it extends to the top members as shown in FIG. 3.

In the case of FIG. 5 of the drawings, provision is made for a "dandy" roll 28, a device employed in "water marking" paper and for "rolling" the pulp web. In this case, the sealing plate 29 is altered to allow for the incorporation of the dandy roll.

The invention, therefore, permits the speed at which the pulp web is formed to be increased over conventional arrangements without affecting the disorientation of the fibers in the final paper or board product. As a result, paper and board having substantially similar physical properties, particularly properties relating to their strength and stretchability in all directions in the plane of the paper, can be obtained at high rates of production. This, in turn, leads to the production of commercial grades of paper of better quality which can be used in the manufacture of bags without the present need for a build-up of large numbers of layers. As a result there is a saving in the amount of paper required for manufacturing paper bags.

Likewise, paper made according to the invention can also be used in the manufacture of tissue and toilet paper. Because of the improved strength of the paper, fewer layers of paper would be required in use.

The same considerations apply to board in which a saving in material and costs can be obtained through the invention.

It is believed that the same saving would apply in other uses of paper and board.

What is claimed is:

1. An apparatus suitable for use in the manufacture of paper and board including:

a screen for movement along a determined path and at a predetermined speed;

a contained feed way terminating in a slit formation for directing a stream of pulp in liquid suspension towards the screen as a curtain extending across at least a portion of the width of the screen, the feed way being located at such an angle to the screen that, for a selected pulp suspension flow rate, the pulp's resultant direction of travel, relative to the screen, is substantially at right angles to the screen;

a chamber into which the feed way discharges, the chamber having an inlet through which the screen passes into the chamber, an outlet through which the screen leaves the chamber, and liquid sealing means at both the chamber inlet and the chamber outlet; and means defining a discharge orifice located below the stream for discharging the excess liquid from the suspension flowing through the screen.

2. An apparatus as claimed in claim 1 in which the liquid sealing means includes one or more rollers.

3. An apparatus as claimed in claim 2 in which a roller for picking a pulp web up off the screen forms the seal at the outlet of the chamber.

4. An apparatus as claimed in claim 3 in which one or more discharge vents are provided below the screen for moving a pulp web formed on the screen into firm contact with the roller for picking the pulp web up off the screen.

5. An apparatus as claimed in claim 1 in which the screen is supported, for at least part of its travel through the chamber, on at least one belt.

6. An apparatus suitable for use in the manufacture of paper and board from a suspension of pulp including:

a screen for movement along a determined path and at a predetermined speed;

a contained feed way terminating in a slit formation for directing a stream of pulp in liquid suspension towards the screen as a curtain extending across at least a portion of the width of the screen, the feed way being located at such an angle to the screen that, for a selected pulp suspension flow rate, the resultant direction of travel of substantially the entire pulp stream, relative to the screen, at the point of impingement of the stream on the screen is substantially at right angles to the screen;

a chamber into which the feed way discharges, the chamber having an inlet through which the screen passes into the chamber, an outlet through which the screen leaves the chamber, and liquid sealing means at both the chamber inlet and the chamber outlet; and discharge means below the point at which the pulp suspension impinges on the screen for discharge of excess liquid passing through the screen at this point.

7. An apparatus as claimed in claim 6 in which the screen is supported, for part of its travel through the chamber, on at least one resilient belt.

* * * * *